US007805105B2

(12) United States Patent
Ishio

(10) Patent No.: US 7,805,105 B2
(45) **Date of Patent: *Sep. 28, 2010**

(54) CLOSING AUXILIARY DEVICE AND IMAGE FORMING APPARATUS THEREWITH

(75) Inventor: Hisaya Ishio, Toda (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/212,468

(22) Filed: Sep. 17, 2008

(65) Prior Publication Data

US 2009/0022533 A1 Jan. 22, 2009

Related U.S. Application Data

(63) Continuation of application No. 11/229,663, filed on Sep. 20, 2005, now Pat. No. 7,437,117.

(30) Foreign Application Priority Data

Sep. 21, 2004 (JP) ..... 2004-273940

(51) Int. Cl.
*G03G 15/00* (2006.01)

(52) U.S. Cl. ..... 399/380; 399/377

(58) Field of Classification Search ..... 399/380, 399/377

See application file for complete search history.

(56) References Cited

U.S. PATENT DOCUMENTS 3,901,594 A 8/1975 Robertson
4,199,081 A 4/1980 Mason
4,509,400 A 4/1985 Smith
4,975,562 A 12/1990 Friedman
5,153,645 A 10/1992 Hasegawa et al.
5,292,117 A 3/1994 Takagi et al.

(Continued)

FOREIGN PATENT DOCUMENTS

CN 1402524 A 3/2003

(Continued)

OTHER PUBLICATIONS

U.S. Appl. No. 11/201,431, filed Aug. 11, 2005, Ishio.

(Continued)

*Primary Examiner*—Judy Nguyen
*Assistant Examiner*—Allister Primo
(74) *Attorney, Agent, or Firm*—Foley & Lardner LLP

(57) ABSTRACT

A closing auxiliary device includes an automatic sheet feeder, a closing auxiliary handle, and a magnet and a metal portion. The automatic sheet feeder is provided in the apparatus main body while being openable and closable by a hinge unit. The closing auxiliary handle is rotatably provided in one side portion of the automatic sheet feeder. The magnet and the metal portion fix the closing auxiliary handle and the automatic sheet feeder. When the automatic sheet feeder is opened to form a predetermined angle between the automatic sheet feeder and the apparatus main body, the closing auxiliary handle is released from the automatic sheet feeder to which the closing auxiliary handle is fixed by the magnet and the metal portion. A projection portion and a rotation control portion are provided in the closing auxiliary handle.

9 Claims, 5 Drawing Sheets

U.S. PATENT DOCUMENTS

| | | | | |
|---|---|---|---|---|
| 5,509,647 | A | 4/1996 | Iwanaga | |
| 5,983,826 | A | 11/1999 | Lohde | |
| 6,108,106 | A | 8/2000 | Hayashi et al. | |
| 6,536,968 | B2 | 3/2003 | Lee et al. | |
| 6,581,926 | B2 | 6/2003 | Hsiao et al. | |
| 6,690,910 | B2 | 2/2004 | Fujimoto | |
| 6,859,638 | B2 | 2/2005 | Nobe | |
| 6,863,367 | B2 | 3/2005 | Hamamoto et al. | |
| 6,863,459 | B2 | 3/2005 | Ikeno et al. | |
| 6,977,735 | B1 | 12/2005 | Ookuma | |
| 7,378,644 | B2 | 5/2008 | Kubota et al. | |
| 7,437,117 | B2 * | 10/2008 | Ishio | 399/380 |
| 2005/0196212 | A1 | 9/2005 | Takemoto et al. | |
| 2006/0099017 | A1 | 5/2006 | Yeh et al. | |

FOREIGN PATENT DOCUMENTS

| | | | |
|---|---|---|---|
| JP | 03-186530 | A | 8/1991 |
| JP | 04-113876 | A | 4/1992 |
| JP | 06-144594 | A | 5/1994 |
| JP | 08-334941 | A | 12/1996 |
| JP | 2003-066544 | A | 3/2003 |
| JP | 2003-069763 | A | 3/2003 |
| JP | 2003-110768 | A | 4/2003 |
| JP | 2003-344960 | A | 12/2003 |

OTHER PUBLICATIONS

H. Ishio, US PTO Office Action U.S. Appl. No. 11/201,431, dated Apr. 13, 2009, 13 pgs.

H. Ishio, US PTO Office Action U.S. Appl. No. 11/201,431, dated Nov. 9, 2009, 13 pgs.

* cited by examiner

CLOSING AUXILIARY DEVICE AND IMAGE FORMING APPARATUS THEREWITH

CROSS-REFERENCE TO RELATED APPLICATIONS

The present application is a Continuation of U.S. application Ser. No. 11/229,663, filed Sep. 20, 2005, the entire contents of which is incorporated herein by reference.

This application is based upon and claims the benefit of priority from prior Japanese Patent Application No. 2004-273940, filed Sep. 21, 2004, the entire contents of which are incorporated herein by reference.

BACKGROUND OF THE INVENTION

1. Field of the Invention

The present invention relates to a closing auxiliary device supplementarily used for closing an opening and closing member incorporated in an apparatus main body and an image forming apparatus, which is equipped with the closing auxiliary device and forms an image of an original on a sheet.

2. Description of the Related Art

It is known that some pieces of the image forming apparatus, such as a copying machine, are provided with an automatic sheet feeder (opening and closing member) which is attached to the surface of a document glass by a hinge so as to be openable and closable. The automatic sheet feeder has a function of sending automatically and continuously plural originals to the surface of a document glass. In the automatic sheet feeder, original pressing means for bringing the plural originals into contact with the document glass is provided in a plane opposing the document glass.

Some pieces of the image forming apparatus provided with the automatic sheet feeder have an auxiliary lever which opens and closes the automatic sheet feeder. The auxiliary lever is utilized for a wheelchair user and a child who cannot reach the automatic sheet feeder. For example, there is known the auxiliary lever in which a first grip and a second grip are provided in the original pressing means. The first grip opens and closes the original pressing means and the second grip is located below the first grip when the original pressing means is opened fully to open the document glass.

In the image forming apparatus having the auxiliary lever, the auxiliary lever is suspended from the automatic sheet feeder when the automatic sheet feeder is opened fully from the document glass. Therefore, the suspended auxiliary lever becomes a hindrance under the assumption that a wheelchair user or a child does not use the image forming apparatus. In this case, a stop lever is rotated to lock a stop portion so that the auxiliary lever is not suspended (for example, see Jpn. Pat. Appln. KOKAI Publication No. 2003-344960).

However, when the automatic sheet feeder is opened, the second grip is suspended unless the second grip is not locked by the stop lever. That is, in the situation where a wheelchair user or a child uses the automatic sheet feeder, the auxiliary lever is always suspended and becomes a hindrance when a healthy person or an adult places an original on the document glass. When the auxiliary lever is locked by the stop lever for being a hindrance, there is a problem that a wheelchair user or a child cannot use the automatic sheet feeder.

Further, Jpn. Pat. Appln. KOKAI Publication No. 2003-66544 discloses the closing auxiliary device including a closing auxiliary lever and a protruding piece and recess. The closing auxiliary lever is provided in the automatic sheet feeder while being able to be suspended when the automatic sheet feeder is opened. The closing auxiliary lever aids the closing of the automatic sheet feeder when maintained in an open state in which the automatic sheet feeder, attached to the apparatus main body vertically to be openable and closable, is opened at angles larger than a predetermined angle less than 90 degrees with respect to the apparatus main body. The protruding piece and recess control the rotation of the closing auxiliary lever in a direction in which the closing auxiliary lever is separated from an opening and closing base portion of the automatic sheet feeder when the automatic sheet feeder is opened.

In the image forming apparatus provided with the closing auxiliary device, there is a problem that the configuration becomes complicated and the apparatus becomes expensive.

BRIEF SUMMARY OF THE INVENTION

An object of the invention is to provide a closing auxiliary device, by which the opening and closing member can be closed even, for example, by a wheelchair user who cannot reach the opening and closing member left opened, and an image forming apparatus provided with the closing auxiliary device.

A closing auxiliary device according to the present invention includes an opening and closing member which is attached to an apparatus main body via coupling means so as to be openable and closable; a closing auxiliary member which is attached to at least one side part of the opening and closing member while being rotatable; and a fixing member which holds the closing auxiliary member and the opening and closing member together, in which the closing auxiliary member is released from the opening and closing member to which the closing auxiliary member is attached by the fixing member if the opening and closing member is opened and forms a predetermined angle with the apparatus main body. The closing auxiliary device is provided with a protruding portion and a rotation control portion. If the protruding portion comes into contact with the apparatus main body, the closing auxiliary device is released from the opening and closing device, and, at the same time, the rotation control portion comes into contact with the opening and closing device, thereby controlling the position of the closing auxiliary device.

According to the invention, even a wheelchair user who cannot reach the opening and closing member left opened can put a hand on the closing auxiliary member and simply and securely close the opening and closing member.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
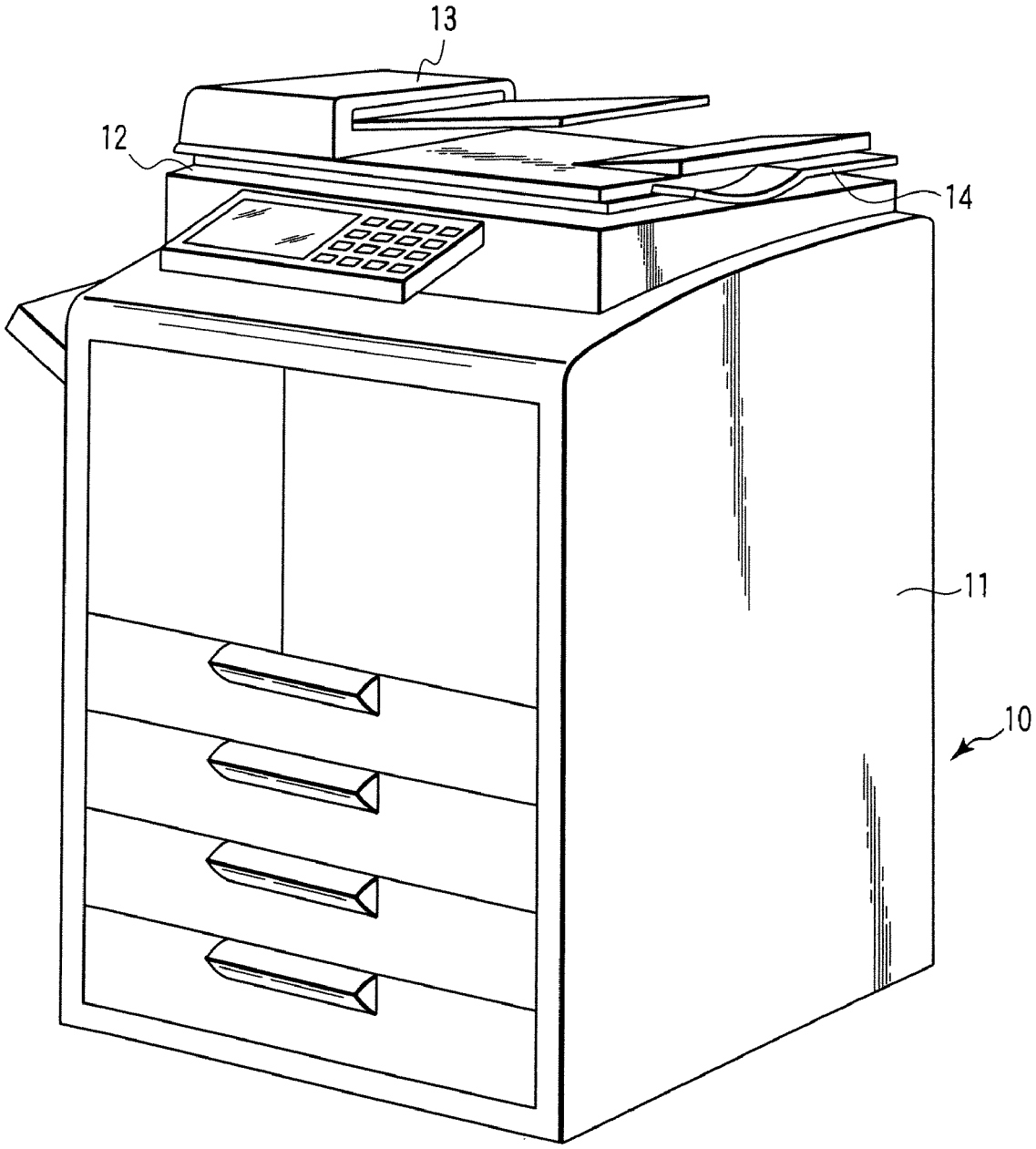
FIG. 1 is a perspective view showing a schematic configuration of a copying machine which is of an image forming apparatus provided with a closing auxiliary device according to an embodiment of the invention as a part of a constituent.

FIG. 1 is a perspective view showing a copying machine (image forming apparatus) in which a closing auxiliary device according to an embodiment of the invention is incorporated. Numerical values indicated in the embodiments are used only as reference, and the invention is not limited to these numerical values.

FIG. 1 shows the copying machine which is of a kind of the image forming apparatus of the embodiment. A copying machine 10 has an image reading unit 12 in an upper portion of an apparatus main body 11. An automatic sheet feeder 13 is provided on the image reading unit 12 while being openable and closable with respect to the apparatus main body 11. The automatic sheet feeder 13 is the opening and closing member and the automatic sheet feeder 13 is also original supplying means. The copying machine 10 includes a rotatable, closing auxiliary handle 14 which is of the closing auxiliary member in at least one side portion of the automatic sheet feeder 13.

In the case where a wheelchair user uses the copying machine 10 while the automatic sheet feeder 13 is kept opened, the wheelchair user can close the automatic sheet feeder 13 by pulling the closing auxiliary handle 14, when the wheelchair user cannot close the automatic sheet feeder 13 to use the copying machine 10 because the wheelchair user cannot reach the automatic sheet feeder 13.

Figure 2:
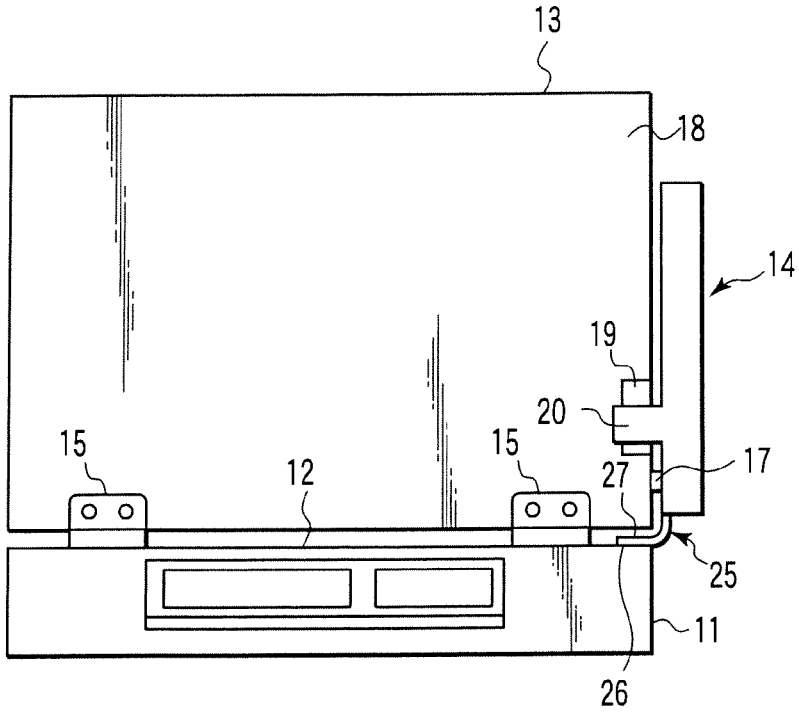
FIG. 2 is a front elevation showing the schematic configuration of the automatic sheet feeder of FIG. 1 while opened.
Figure 3:
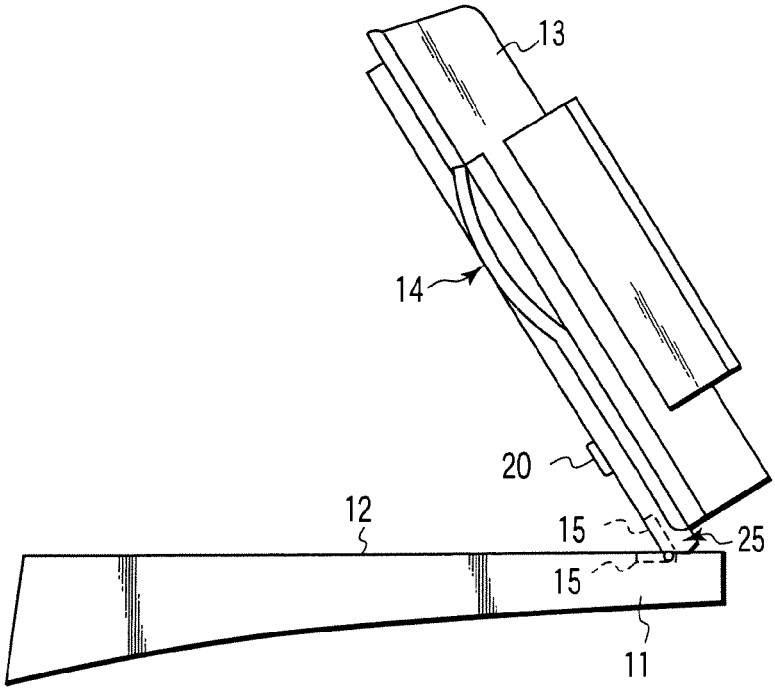
FIG. 3 is a right side elevation showing the automatic sheet feeder of FIG. 2 while a lower portion of the automatic sheet feeder is omitted.
Figure 4:
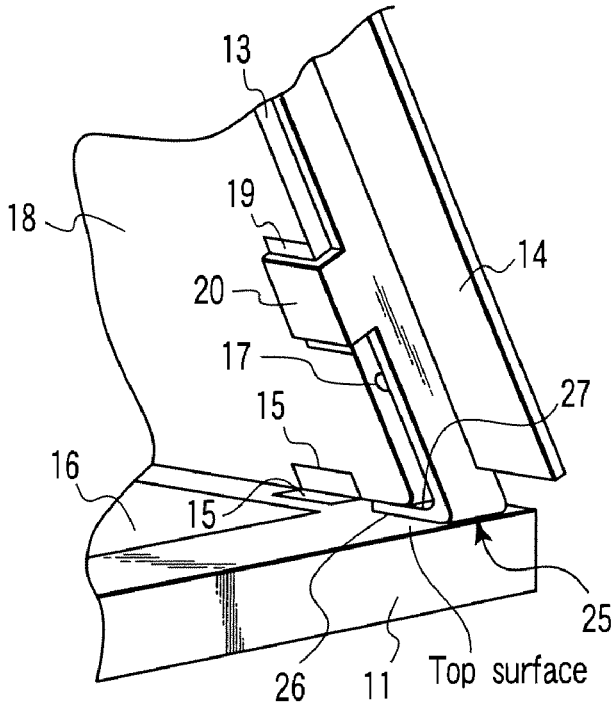
FIG. 4 is a schematic perspective view showing the automatic sheet feeder of FIG. 3 while opened.

As shown in FIGS. 2 to 4, the automatic sheet feeder 13 is openably and closably attached to the apparatus main body 11 by a pair of hinge units 15 and 15 which are of connecting means. Because the configuration of the hinge units 15 and 15 is a well-known art, the description of the hinge units 15 and 15 is omitted.

As shown in FIG. 4, in order to easily place the original in placing the original on a document glass 16 provided on a top surface of the apparatus main body 11, when the automatic sheet feeder 13 is opened at a predetermined angle (specifically 15 degrees) or larger, the automatic sheet feeder 13 is configured to be held by the hinge units 15 and 15 at the predetermined angle. Furthermore, the closing auxiliary handle 14 is rotatably attached to at least one side portion of the automatic sheet feeder 13 by a shaft 17. An axial direction of the shaft 17 is parallel to a rotating axis of the hinge units 15 and 15.

A magnet 19 which is of a fixing member is attached to an original pressing portion 18 provided in a backside of the automatic sheet feeder 13. A metal portion 20 which is of the fixing member is provided in the closing auxiliary handle 14. The metal portion 20 is held to the magnet 19 by magnetic force while the automatic sheet feeder 13 is kept opened at the predetermined angle, when the original is taken out from the automatic sheet feeder 13.

Thus, with this configuration, the magnet 19 and the metal portion 20 are fixed to each other by the magnetic force by opening the automatic sheet feeder 13, so that the automatic sheet feeder 13 is followed by the closing auxiliary handle 14. In the embodiment, the magnet 19 and the metal portion 20 are used in order to fix or release the automatic sheet feeder portion 13 and the closing auxiliary handle 14; however, the invention is not limited to the magnet 19 and the metal portion 20. Alternatively, a recess is formed in one of the automatic sheet feeder 13 and the closing auxiliary handle 14, a projection is formed in the other, elasticity is imparted to the recess, and the projection may be locked in and unlocked from the recess.

Figure 5:
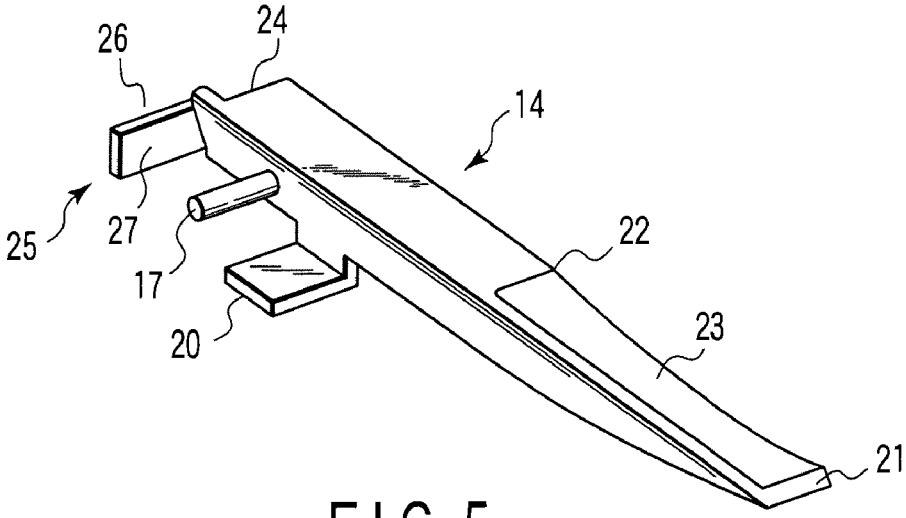
FIG. 5 is a perspective view showing the closing auxiliary handle of FIG. 1.

As shown in FIG. 5, the closing auxiliary handle 14 has a curve portion 23 curved on its upper surface from a front end portion 21 to a central portion 22. The shaft 17 and metal portion 20 which is of the fixing member are provided in one side portion of the closing auxiliary handle 14, and a protruding piece 25 is provided in a rear end portion 24 of the closing auxiliary handle 14. The protruding piece 25 has two functions. First, an outside portion of the protruding piece 25 functions as an abutting portion 26 which releases the magnetic hold to separate the magnet 19 from the metal portion 20 by bringing the outside portion into contact with the top surface of the apparatus main body 11. Second, an inside portion of the protruding piece 25 functions as a rotation control portion 27. The rotation control portion 27 controls the angle between the closing auxiliary handle 14 and the automatic sheet feeder 13 to a certain angle by abutting the inside portion on the backside of the automatic sheet feeder 13.

Figure 6:
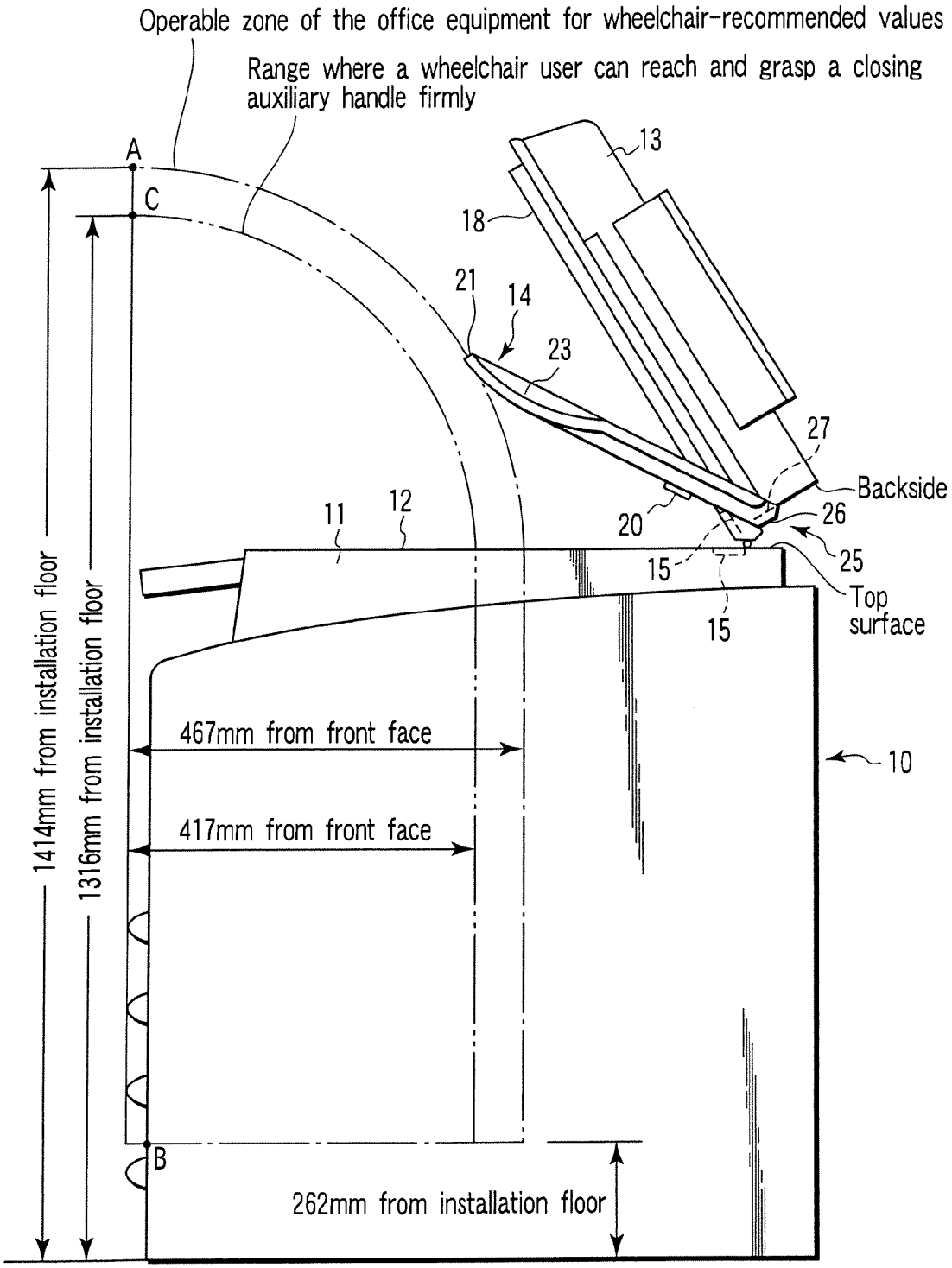
FIG. 6 is a right side elevation showing the schematic configuration of the copying machine when the closing auxiliary handle is opened while the automatic sheet feeder is opened fully from the state of FIG. 1.

As shown in FIG. 6, when the user of the copying machine 10 opens the automatic sheet feeder 13 upward while holding a position located farthest from the hinge unit 15 sides with the user's hand, the abutting portion 26 of the closing auxiliary handle 14 comes into contact with the top surface of the apparatus main body 11. When the automatic sheet feeder portion 13 is further moved, the metal portion 20 is moved about the shaft 17 relative to the magnet 19. Then, the metal portion 20 held by the magnet 19 is released, and the closing auxiliary handle 14 is suspended from the automatic sheet feeder 13.

The use of the general copying machine will be described with reference to upper limit values and lower limit values of a depth and a height described in "JBMIA-TR-8-2004 Operable Zone of the Office Equipment for Wheelchair—Recommended Values—."

It is assumed that a wheelchair user operates the copying machine 10 while the wheelchair is placed alongside the front face of the copying machine 10. In a depth distance, the range in which the wheelchair user reaches the front end portion 21 of the closing auxiliary handle 14 is about 467 mm, when the wheelchair user declines the person's body from the front face of the copying machine 10. The distance between an installation floor and an upper limit position A which the hand of the wheelchair user can reach is about 1414 mm, and the distance between the installation floor and a lower limit position B which the hand of the wheelchair user can reach is about 262 mm. These associated positions are indicated by alternate long and short dashed lines. In the case where the wheelchair user can firmly grasp the closing auxiliary handle 14, the reachable distance of the wheelchair user is about 417 mm from the front face, and the distance between the installation floor and an upper limit position C which the hand of the wheelchair user can reach is about 1364 mm. These associated positions are indicated by a chain double-dashed line.

Thus, the maximum depth distance in which a wheelchair user can reach the front end portion 21 of the closing auxiliary handle 14 from the front face substantially ranges from 417 mm to 467 mm, and the distances from the installation floor to the upper limit positions A and C substantially range from 1364 mm to 1414 mm. The front end portion 21 of the closing auxiliary handle 14 attached on the automatic sheet feeder 13 is preferably set in an area defined by the above distances.

Accordingly, a wheelchair user on the installation floor of the copying machine 10 becomes able to use the copying machine 10 by operating the closing auxiliary handle 14 to close the automatic sheet feeder 13 easily.

Figure 7:
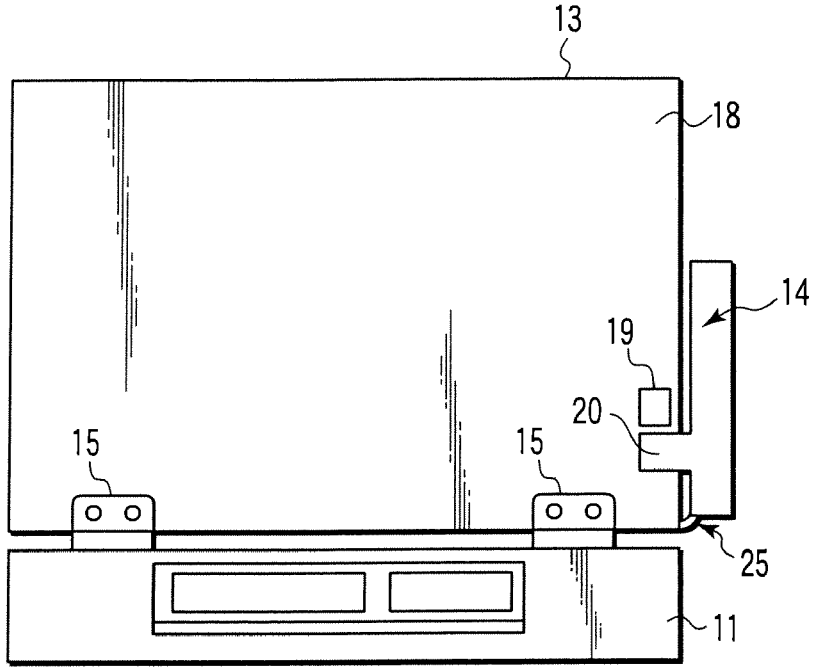
FIG. 7 is a front elevation showing the schematic configuration of the automatic sheet feeder of FIG. 2 when the closing auxiliary handle is opened while the automatic sheet feeder is opened fully.

The action of the closing auxiliary handle 14 will be specifically described with reference to FIGS. 7 and 8. When the user of the copying machine 10 opens the automatic sheet feeder 13, the abutting portion 26 of the closing auxiliary handle 14 comes into contact with the top surface of the apparatus main body 11 as shown in FIG. 4.

When the automatic sheet feeder 13 in the state shown in FIG. 4 is further opened upward, the abutting portion 26 of the closing auxiliary handle 14 is moved about the shaft 17 while pressed against the top surface of the apparatus main body 11; therefore, the positional relationship between the magnet 19 and the metal portion 20 which are fixed by the magnetic force is also moved, and shift the magnet 19 and the metal portion 20 from each other, and the magnetic force does not work. Further, when the automatic sheet feeder 13 is opened at the maximum predetermined angle, the abutting portion 26 is released from the top surface of the apparatus main body 11.

Figure 8:
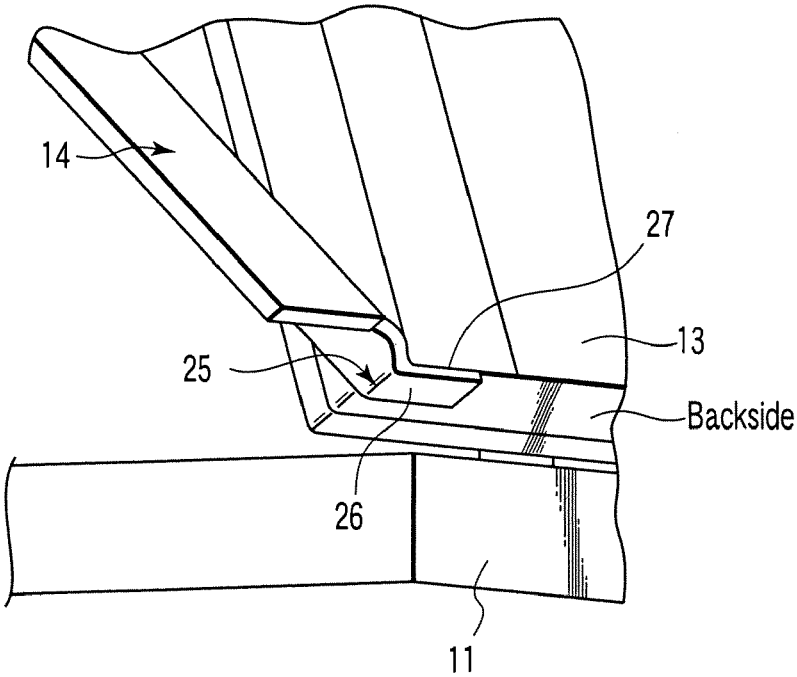
FIG. 8 is a perspective view showing the schematic configuration of the automatic sheet feeder of FIG. 7.

As shown in FIG. 8, the abutting portion 26 released from the top surface of the apparatus main body 11 loses the function, and the rotation control portion 27 is abutted on the backside of the automatic sheet feeder 13 instead. Since the rotation control portion 27 is abutted on the backside of the automatic sheet feeder 13, the closing auxiliary handle 14 is controlled so as not to be opened beyond necessity with respect to the automatic sheet feeder 13. Accordingly, the closing auxiliary handle 14 is held about the shaft 17 while suspended from the automatic sheet feeder 13.

When a wheelchair user closes the opened automatic sheet feeder 13 in using the copying machine 10, the wheelchair user moves the automatic sheet feeder 13 downward by putting the person's hand on the front end portion 21 or the curve portion 23 of the closing auxiliary handle 14, which allows the automatic sheet feeder 13 to be closed onto the apparatus main body 11 side while the rotation control portion 27 is abutted on the backside of the automatic sheet feeder 13. In the closed state, while the rotation control portion 27 is released from the abutment on the backside of the automatic sheet feeder 13, the abutting portion 26 is released from the abutment on the apparatus main body 11. Therefore, the magnet 19 and the metal portion 20 which are of the fixing member are fixed to each other by the magnetic force, and the automatic sheet feeder 13 is followed by the closing auxiliary handle 14.

Thus, according to the configuration of the embodiment, in the case where a wheelchair user uses the copying machine 10 while the automatic sheet feeder 13 is kept opened, the wheelchair user can close the automatic sheet feeder 13 by pulling the closing auxiliary handle 14, when the wheelchair user cannot close the automatic sheet feeder 13 to use the copying machine 10 because the wheelchair user cannot reach the automatic sheet feeder 13.

On the other hand, when the automatic sheet feeder 13 is being opened, the closing auxiliary member 14 never becomes a hindrance because the closing auxiliary handle 14 opens together with the automatic sheet feeder 13 until the predetermined angle.

When a physically unimpaired person leaves the apparatus main body 11 while the automatic sheet feeder 13 is kept opened at angles larger than the predetermined angle, since the closing auxiliary handle 14 is suspended, the wheelchair user can close the automatic sheet feeder 13 with the closing auxiliary handle 14.

In the embodiment, the closing auxiliary handle 14 is attached to the outside of the automatic sheet feeder 13; however, the closing auxiliary handle 14 may be attached to the inside of the automatic sheet feeder 13. The closing auxiliary handle 14 may be formed by plural members as a fishing rod. Moreover, the closing auxiliary handle 14 may be folded into two. When a wheelchair user uses the copying machine 10, the closing auxiliary handle 14 may be provided so as to be retractable in a longitudinal direction of the closing auxiliary handle 14 because individual difference exists in physical size depending on sexuality and the like.

Examples of the image forming apparatus according to the invention include a printer and a facsimile in addition to a copying machine. Therefore, the image forming apparatus into which the closing auxiliary device according to the embodiment of the invention is incorporated as a part of the constituent is not limited to the copying machine.

As described above, the invention is not limited to the above embodiment, but various modifications could be made without departing from the spirit and scope of the invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A closing method comprising:

attaching an opening and closing member to an apparatus main body through a hinge while being openable and closable about an opening and closing shaft, the opening and closing member having a magnetic portion;

rotating a closing auxiliary member provided in the opening and closing member while being rotatable about a rotating axis in parallel with the opening and closing shaft, within an angle range between a closed position of the opening and closing member and a current position of the opening and closing member in order to aid the opening and the closing of the opening and closing member, the closing auxiliary member having a fixing member for interaction with the magnetic portion;

detachably holding the closing auxiliary member in the opening and closing member by a magnetic force between the magnetic portion and the fixing member;

detachably releasing the closing auxiliary member from the opening and closing member, via the fixing member, by bringing an abutting portion provided in the closing auxiliary member into contact with the apparatus main body when the opening and closing member is opened at a predetermined angle from a closed state while the closing auxiliary member is held in the opening and closing member; and controlling a position of the closing auxiliary member within the angle range by bringing a rotation control portion of the closing auxiliary member into contact with a back side of the opening and closing member, while the closing auxiliary member is detachably released from the opening and closing member, and rotating the closing auxiliary member in a same direction of rotation as the opening and closing member.

2. A closing method according to claim 1, wherein the closing auxiliary member is provided outside the opening and closing member.

3. A closing method according to claim 1, wherein the closing auxiliary member is detachably provided in the opening and closing member.

4. An closing method comprising:

attaching an opening and closing member to an apparatus main body through a hinge while being openable and closable about an opening and closing shaft, the opening and closing member having a magnetic portion;

rotating a closing auxiliary member detachably provided in the opening and closing member while being rotatable about a rotating axis in parallel with the opening and closing shaft, within an angle range between a closed position of the opening and closing member and a current position of the opening and closing member in order to aid the opening and the closing of the opening and closing member, the closing auxiliary member having a fixing member for interaction with the magnetic portion;

detachably holding the closing auxiliary member in the opening and closing member by a magnetic force between the magnetic portion and the fixing member;

detachably releasing the closing auxiliary member from the opening and closing member, via the fixing member, by bringing an abutting portion provided in the closing auxiliary member into contact with the apparatus main body when the opening and closing member is opened at a predetermined angle from a closed state while the closing auxiliary member is held in the opening and closing member; and controlling a position of the closing auxiliary member within the angle range by bringing a rotation control portion of the closing auxiliary member into contact with a back side of the opening and closing member, while the closing auxiliary member is detachably released from the opening and closing member.

5. A closing method according to claim 4, wherein the closing auxiliary member is provided outside the opening and closing member.

6. An image forming method comprising:

attaching an opening and closing member to an original supply means through a hinge while being openable and closable about an opening and closing shaft, the opening and closing member having a magnetic portion;

rotating a closing auxiliary member provided in the opening and closing member while being rotatable about a rotating axis in parallel with the opening and closing shaft, within an angle range between a closed position of the opening and closing member and a current position of the opening and closing member in order to aid the opening and the closing of the opening and closing member, the closing auxiliary member having a fixing member for interaction with the magnetic portion;

detachably holding the closing auxiliary member in the opening and closing member by a magnetic force between the magnetic portion and the fixing member;

detachably releasing the closing auxiliary member from the opening and closing member, via the fixing member, by bringing an abutting portion provided in the closing auxiliary member into contact with the original supply means when the opening and closing member is opened at a predetermined angle from a closed state while the closing auxiliary member is held in the opening and closing member; and controlling a position of the closing auxiliary member within the angle range by bringing a rotation control portion of the closing auxiliary member into contact with a back side of the opening and closing member, while the closing auxiliary member is detachably released from the opening and closing member, and rotating in a same direction of rotation as the opening and closing member.

7. An image forming method comprising:

attaching an opening and closing member to an original supplying means through a hinge while being openable and closable about an opening and closing shaft, the opening and closing member having a magnetic portion;

rotating a closing auxiliary member detachably provided in the opening and closing member while being rotatable about a rotating axis in parallel with the opening and closing shaft, within an angle range between a closed position of the opening and closing member and a current position of the opening and closing member in order to aid the opening and the closing of the opening and closing member, the closing auxiliary member having a fixing member for interaction with the magnetic portion;

detachably holding the closing auxiliary member in the opening and closing member by a magnetic force between the magnetic portion and the fixing member;

detachably releasing the closing auxiliary member from the opening and closing member, via the fixing member, by bringing an abutting portion provided in the closing auxiliary member into contact with the original supply means when the opening and closing member is opened at a predetermined angle from a closed state while the closing auxiliary member is held in the opening and closing member; and controlling a position of the closing auxiliary member within the angle range by bringing a rotation control portion of the closing auxiliary member into contact with a back side of the opening and closing member, while the closing auxiliary member is detachably released from the opening and closing member.

8. A closing auxiliary device comprising:

an opening and closing member which is attached to an apparatus main body through a hinge while being openable and closable about an opening and closing shaft, the opening and closing member having a magnetic portion;

a closing auxiliary member provided in the opening and closing member while being rotatable about a rotating axis in parallel with the opening and closing shaft, the closing auxiliary member being rotated within an angle range between a closed position of the opening and closing member and a current position of the opening and closing member in order to aid the opening and the closing of the opening and closing member, the closing auxiliary member having a fixing member for interaction with the magnetic portion;

the fixing member detachably holds the closing auxiliary member in the opening and closing member by a magnetic force between the magnetic portion and the fixing member;

an abutting portion provided in the closing auxiliary member, the abutting portion detachably releasing the closing auxiliary member form the opening and closing member by coming into contact with the apparatus main body when the opening and closing member is opened at a predetermined angle from a closed state while the closing auxiliary member is held in the opening and closing member; and a rotation control portion which controls a position of the closing auxiliary member within the angle range by coming into contact with a back side of the opening and closing member, while the closing auxiliary member is detachably released from the opening and closing member, the rotation control portion limiting the rotation of the closing auxiliary member in a same direction of rotation as a closing direction of rotation of the opening and closing member.

9. An image forming apparatus comprising:

original supplying member;

an opening and closing member which is attached to the original supplying member through a hinge while being openable and closable about an opening and closing shaft, the opening and closing member leaving a magnetic portion;

a closing auxiliary member provided in the opening and closing member while being rotatable about a rotating axis in parallel with the opening and closing shaft, the closing auxiliary member being rotated within an angle range between a closed position of the opening and closing member and a current position of the opening and closing member in order to aid the opening and the closing of the opening and closing member, the closing auxiliary member having a fixing member for interaction with the magnetic portion;

the fixing member detachably holds the closing auxiliary member in the opening and closing member by a magnetic force between the magnetic portion and the fixing member;

an abutting portion provided in the closing auxiliary member, the abutting portion detachably releasing the closing auxiliary member from the opening and closing member by coming into contact with the original supplying member when the opening and closing member is opened at a predetermined angle from a closed state while the closing auxiliary member is held in the opening and closing member;

and a rotation control portion which controls a position of the closing auxiliary member within the angle range by coming into contact with a back side of the opening and closing member, while the closing auxiliary member is detachably released from the closing member, the rotation control portion limiting the rotation of the closing auxiliary member in a same direction of rotation as a closing direction of rotation of the opening and closing member.

* * * * *